United States Patent [19]

Muckler et al.

[11] Patent Number: 4,784,114

[45] Date of Patent: Nov. 15, 1988

[54] KITCHEN VENTILATING SYSTEM

[75] Inventors: Frank Muckler, Stone Mountain, Ga.; Edward B. Vandas, St. Louis, Mo.

[73] Assignee: Richard F. Muckler, Commerce City, Colo.

[21] Appl. No.: 613,010

[22] Filed: May 21, 1984

Related U.S. Application Data

[63] Continuation of Ser. No. 374,991, May 5, 1982, abandoned.

[51] Int. Cl.[4] ..... F21C 15/20

[52] U.S. Cl. ..... 126/299 E; 126/299 R; 126/299 D; 74/424.8 NA; 55/DIG. 36

[58] Field of Search ..... 126/142, 285 B, 285.5, 126/299 R, 299 D, 299 E, 300, 301; 55/210, 212, 217, 242, DIG. 36; 74/216.3, 424.8 NA; 169/60, 61, 65; 236/49

[56] References Cited

U.S. PATENT DOCUMENTS

| | | | |
|---|---|---|---|
| 2,739,491 | 3/1956 | Russell | 74/424.8 NA X |
| 2,813,477 | 11/1957 | Gaylord | 126/299 E |
| 2,961,941 | 11/1960 | Graswich et al. | 126/299 D |
| 2,971,452 | 2/1961 | Graswich et al. | 126/299 D |
| 3,065,687 | 11/1962 | Graswich et al. | 126/299 D |
| 3,566,585 | 3/1971 | Voloshen et al. | 55/DIG. 36 X |
| 3,785,124 | 1/1974 | Gaylord, II. | 126/299 E X |
| 3,834,135 | 9/1974 | Jordan | 55/DIG. 36 X |
| 4,050,446 | 9/1977 | Giuffre | 126/299 E |
| 4,066,064 | 1/1978 | Vandas | 126/299 E |
| 4,103,676 | 8/1978 | Kastner | 55/DIG. 36 X |
| 4,273,097 | 6/1981 | Szwartz | 126/285 B |

*Primary Examiner*—Larry Jones
*Assistant Examiner*—Carl D. Price
*Attorney, Agent, or Firm*—Kalish & Gilster

[57] ABSTRACT

A cooking or ventilating system has an extraction unit connected through an exhaust duct with the outside atmosphere, and a damper which is shiftable between positions operatively opening or closing the exhaust duct. A mechanism for opening and closing the damper under power includes an electric motor and a ball screw linear actuator driven by the motor. Air flow through the system is controlled to prevent exhausted grease from being carried up the exhaust duct. The damper is mounted for closing in the direction of air flow through the system and, when opened, for shielding the drive mechanism from smoke and grease, etc., in the air flow. Control circuits provide automatically timed normal operation of the motor as well as control operation of detergent and spray wash apparatus of the ventilating system. The control circuits also include a thermosatic sensor arrangement for sensing temperatures within the extraction unit. In the event of a fire, the damper is closed by automatically initiated operation of the motor and water spray through the spray wash apparatus is initiated.

13 Claims, 3 Drawing Sheets

KITCHEN VENTILATING SYSTEM

CROSS REFERENCE TO RELATED APPLICATION

This application is a continuation of application Ser. No. 374,991, filed May 5, 1982, now abandoned.

BACKGROUND AND SUMMARY OF THE INVENTION

This invention relates to cooking or kitchen ventilation systems and, more particularly, to an improved ventilation system of this type for use in various commercial and institutional establishments.

In commercial and institutional cooking kitchens, restaurants and fast food service establishments, a powered exhaust system commonly is used to remove the cooking fumes from the kitchen for discharge to the outside atmosphere. A hood in the kitchen generally overlying the particular cooking appliances collects the fumes, and an exhaust duct from the hood in turn typically extends upwardly within the building structure to an outside outlet higher than the hood. A blower commonly provides negative pressure in the duct for forced venting of the kitchen air and fumes from the hood and through the exhaust duct.

Because of the need to be concerned with increasingly stringent fire regulations and the desire to increase safety and efficiency, these so-called kitchen ventilation systems have become increasingly technically complex, requiring painstaking and scientific design during which many parameters, specifications, concerns and hazards must be kept in mind by the design engineer.

The possibility of fire is a most important hazard to be addressed because of the presence of grease, smoke gases, volatiles and other flammable substances rising from the cooking area or carried upward into the ventilation, in view of the cooking heat or even open flames from cooking. Consequently, a fire damper is often required to be installed in the duct system, the damper being held open by a heat fusible link and closed by a weight or spring when the link is melted. Fire dampers are seldom operated on a regular basis, so that the grease-laden air can bind the damper journals, linkages and other parts to prohibit closing of the damper, as by the action of a weight, if there is a fire.

Another problem of prior art damper arrangements is that if the damper stays open at all times, even when the exhaust blower is off at night, for example, a strong chimney effect can produce loss of significant heat energy, especially in colder climates as heat escapes from the heated building out the open duct.

Manually operated dampers have also been used but usually are not operated regularly and properly over extended periods and if configured to be closed, for example, by a spring or weight in the event of a fire, are prone to failure just like other fire dampers.

For example, a conventional system long used in the industry is typified by the Graswich et al U.S. Pat. Nos. 2,961,941 and 2,971,452 where the damper is manually opened and spring closed. Various release means are described including manually activated, fire activated, and/or electrically activated means to shift a link so that the damper could be spring closed; but manual effort is required to open the damper. In practice, it is rare indeed when such a damper is opened and closed on a regular daily basis, particularly where there are many such damper systems in a single commercial place of business or institution.

A later system is typified by Gaylord U.S. Pat. No. 3,785,124 which utilizes a similar operating mechanism for the so-called make-up damper but which further employs a fresh air damper which is motor opened and spring closed. A limit switch secured adjacent the motor drive is tripped upon the damper being opened fully to deenergize the motor and simultaneously to energize a brake for holding the damper opened. To close the damper, the brake is released and a spring hopefully closes the damper against fixed stops.

Vandas U.S. Pat. No. 4,066,064 discloses an improved arrangement providing for powered opening and closing of the damper with a cylinder operated by water under pressure. This has certain advantages since the damper is opened and closed under power and provision can be made for using the cylinder to open and close the damper daily. This further allows for the tie-in of a fire control system to the same damper which, because of its frequent opening and closing, provides increased assurance that the damper will work in the event of a fire. However, a problem of this system has become evident in cold climates where the downdraft of freezing air within the open duct system can easily freeze the water in the cylinder and/or water lines. This, of course, renders the system inoperative while posing also the risk of rupturing the water lines connected to the actuating cylinder. If there is a multiple ventilator system with multiple actuating cylinders, all operated from a single source of water pressure, the rate of operation of the various cylinders can be different. Another disadvantage is that each such hydraulic cylinder has to be made of durable materials that will resist liquid leakage, heat and corrosion. The system of this patent also requires costly control valving.

Apart from the above, additional problems exist with known damper arrangements. For example, the hood opening typically is defined in wall structure lying in a near vertical plane and, in the usual arrangement, the damper when opened is pivoted about a horizontal upper damper edge, opening into the interior of the hood. Consequently, air exhausted through the hood opening necessarily is passed over the damper itself and grease coats the exposed outer face of the damper. Resultant fouling of the outside surface with grease is itself objectionable, but a more serious problem is that to close the damper, it has to be moved against the direction of the exhausted air moving through the rather restricted hood opening. Even if the blower were deenergized before closing the damper, the inertia, chinmey effect, etc. could yet impose a large force on the damper tending to keep it open. Because of this, the damper closing spring or power cylinder must be designed to be powerful enough to be certain to overcome the possible airflow forces.

A further drawback typically has the actuator extended when the damper is opened and exposed to the exhausted air. This means that in time the exposed operating mechanism can become grease coated and bound, and a cause of malfunction. This would be true, for example, with the power cylinder used in the ventilator arrangement disclosed in Vandas U.S. Pat. No. 4,066,064 which cylinder has an extended piston rod which is exposed to the exhausted air, and thus, may become grease coated and sticky with consequent risk of failure to retract.

An object of the invention is to provide an improved extraction unit for a so-called kitchen ventilating system of the type providing for venting of cooking gases, etc. by interconnection with an exhaust duct communicating to the atmosphere exterior to the kitchen, and useful in myriad industrial, restaurant, fast food and in institutional cooking applications.

It is an object, of the invention to provide such a an extraction unit having a damper which is power actuated for being quickly, easily and reliably opened or closed on periodic intervals, for example, daily, and preventing, when closed, wasteful escape of heat up the exhaust duct.

Another object of the invention is to provide such an extraction unit in which the damper is oriented and pivotally disposed for closing in the direction of air flow through the ventilating system; and, contrariwise, opening into the air flow.

It is a related object of the invention to provide such an extraction unit system in which the damper, when opened, conceals and protects the actuating mechanism to keep grease-laden air and gases from contacting the actuating mechanism; it being also an object of the invention to provide for the actuating mechanism to be in a contracted configuration when the damper is opened so that the actuating mechanism is intrinsically not prone to being fouled, coated with grease, or otherwise interferred with, while the damper is open.

Another object of the invention is to provide such a an extraction in which the damper is electrically actuated but which obviates the need for limit switches, external stops, and other devices which would otherwise be needed to limit movement of the damper.

A further object, of the invention is to provide such an extraction unit system in which the electrically-powered actuating mechanism is provided with sufficiently high operating power and leverage to provide not only rapid but forceful operation of the damper.

It is an object of the invention to provide such a an extraction unit which provides protection during the damper actuating to minimize damage and to prevent injury of persons or objects trapped between the damper and the adjacent structure.

Yet another object of the invention is the provision of such an extraction unit in which the movement of air through the system is accomplished so as to extract grease, grease particles and the like from the air moving through the ventilating system and to preclude the moving air from picking up and carrying the grease, particles, etc. up the exhaust duct.

Another object of the invention is the provision of such a kitchen ventilating system including a novel extraction unit, which provides automatic detergent-and-water washing of the interior of the extraction unit to wash out grease, deposits, and so forth on a daily basis, it being also an object of the invention to provide such a system which carries out water spraying within the extraction unit in the unlikely event of a fire.

Still other objects of the invention include the provision of such a system which is readily usable in any of a wide variety of industrial, restaurants, fast food and institutional cooking applications from large through small; which is extremely well suited to the expansion of kitchen facilities by adding more ventilating systems; which can be used equally well in single or multiple ventilation installations; and which can be designed in an extremely wide range of widths dependent upon the type of installation desired.

Other objects and features will be in part apparent and in part pointed out hereinbelow.

DESCRIPTION OF THE PREFERRED EMBODIMENT

Figure 1:
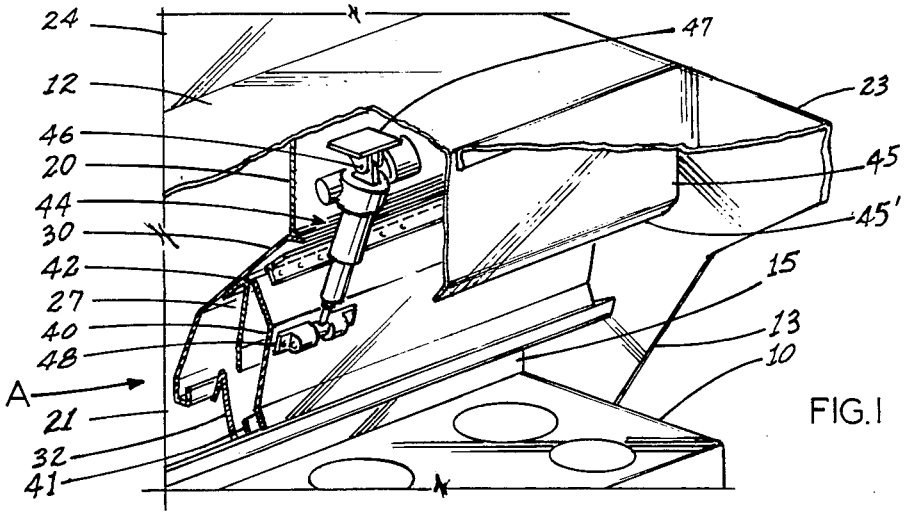
FIG. 1 is a perspective view of a kitchen ventilating system including a novel extraction unit in accordance with and embodying the present invention, being of a fragmentary nature and illustrating, by broken away portions, a certain actuating mechanism of the invention.

Referring to the drawings, and particularly to FIG. 1, A generally designates a so-called kitchen ventilating system of the present invention which is installed above a cooking range or stove 10 representative of the type which might be used in a restaurant, fast food service installation, industrial cooking facility, or other institution. The present invention may be used above grills, open broilers and various other forms of cooking apparatus. The ventilating system A is installed such as against a wall extending along the back of range 10 and provides a ventilator or extraction unit 11 having a top wall 12 and opposed side or end walls 13 (only one being shown) and opposed front and rear walls 14 and 21, respectively, each of which depends from the top wall. The extraction unit 11 captures hot air, smoke and fumes as well as grease and grease vapors rising from range 10. Unit 11 also defines an interior enclosure or plenum 18, confined in part b the top wall 12, by a sloping bottom wall 19, by the opposed front and rear walls 14 and 21, respectively, and by the two end walls 13. An extraction chamber 22 is formed within unit 11. A hood 23 may extend outwardly from unit 11, as shown, or may be separate from unit 11.

Figure 2:
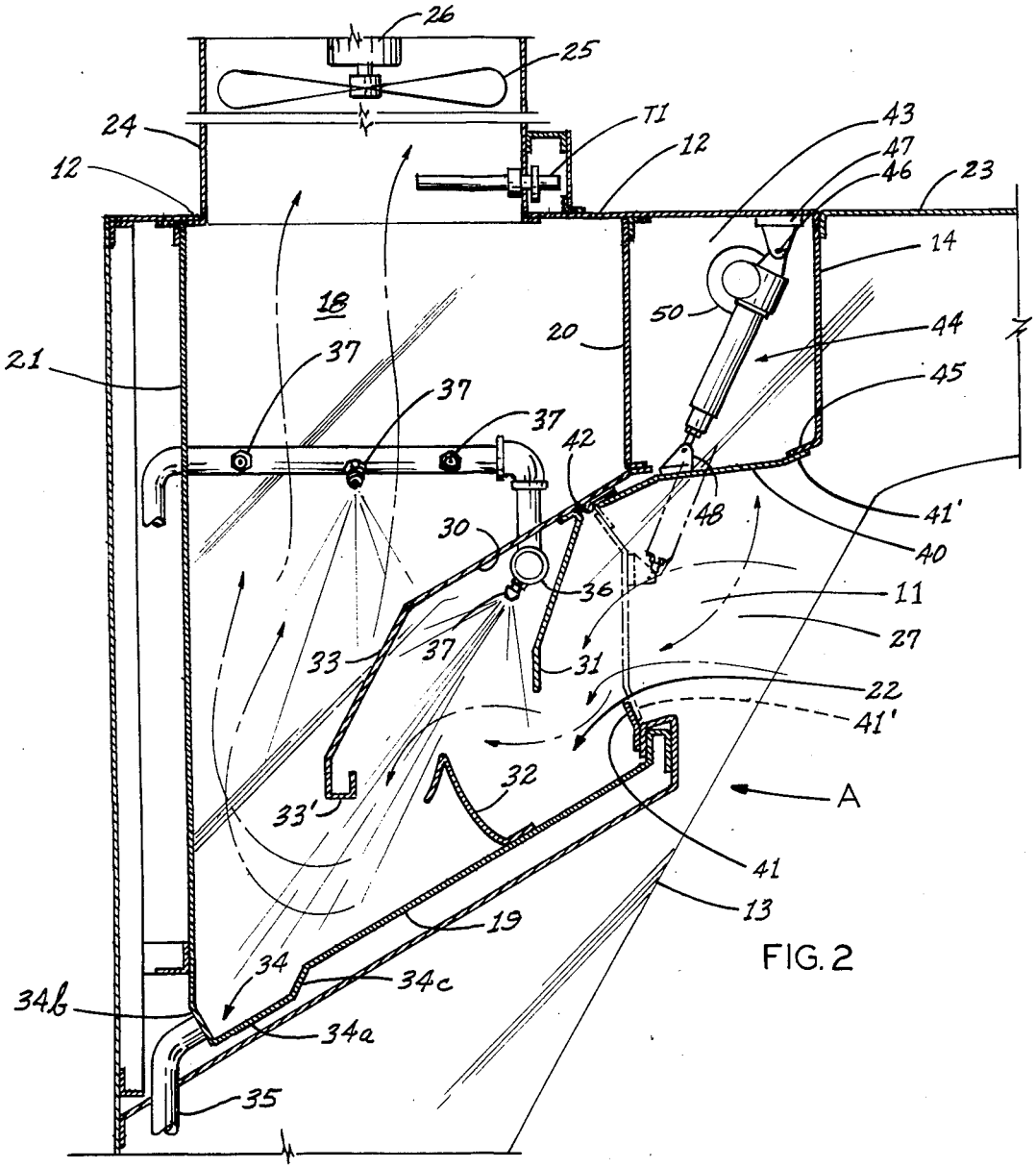
FIG. 2 is a vertical cross-section taken generally along line 2—2 of FIG. 1, and particularly illustrating the path of air flow within the system as well as the actuation of a damper of the system.

Referring to FIG. 2, connected to the plenum 18 is an exhaust collar 24 that extends through the building structure, i.e., through the ceiling, walls or the roof (none shown) to the exterior atmosphere. A blower or fan 25 powered by a motor 26 is operated in normal conditions to create a negative pressure in the plenum 18 for drawing the hot air, smoke, fumes and so forth through the extraction chamber 22, which has an inlet or opening 27 into ventilator unit 11.

The interior of unit 11 and its structure provides a centrifugal grease extractor. More specifically, an interior passageway is provided by a wall 30 disposed generally parallel to the sloping bottom wall 19 of chamber 22. Alternating baffles 31, 32 and 33 extend partly across the passageway defined in chamber 22, being slanted inwardly so that the air flow is initially directed upwardly around the lower end of the front baffle 31, is then directed downwardly around the upper end of the intermediate baffle 32, and then is directed upwardly around the flanged lower end 33' of rear baffle 33. As the air is forced to curve around the interrupting baffles, the entrained grease and especially heavier grease particles, droplets, etc. suspended in the air are thrown off by centrifugal force and are separated out from the air stream and accumulated in a gutter 34. The relatively clean air, substantially freed of particles and droplets of grease, is then drawn up into exhaust collar 24.

In accordance with this invention, gutter 34 is of special configuration. Extending across the entire width of back wall 21 of extraction unit 11, gutter 34 has a sloping bottom wall or floor **34*a*, a sloping rear wall 34*b* and a further front wall 34*c* which drops slopingly from the floor 19 of chamber 22 to provide a lip or recess with the bottom wall 34*a* of the gutter being located, accordingly, below the plenum floor 19. Because of this arrangement, air directed around the end 33' of baffle 33 substantially follows the floor 19 before being directed back upwardly into the plenum and thence through duct 24 and is prevented from dipping down into the floor 34*a*, which is depressed, of gutter 34. Accordingly, the grease which has accumulated and is draining off into gutter 34 is kept well out of the air flow to prevent the air from re-entraining the grease and carrying it up the back wall 21. The grease in gutter 34 is drained off through a drain connection 35 of conventional character so that grease does not accumulate to any substantial extent in gutter 34**.

Also illustrated is a wash system having a pipe 36 for providing water and/or a water and detergent mixture under pressure to spray nozzles 37 provided to discharge the mixture at high velocity into the unit 11. A conventional motor driven pump (not shown) is used for this purpose. This cuts grease and dirt buildup on the walls and flushes the same down drain 35. The exact details of the wash system, baffle arrangement or ventilator structure are subject to variation and the configuration shown is merely representative.

Opening 27 into unit 11 is adapted to be closed by a swingably disposed damper 40 which is hingedly secured for being shifted between an open position (as illustrated in solid FIG. 2) and a closed position (as illustrated in phantom in FIG. 2) disposed crosswise to the air flow through the vent opening. The vent opening 27 typically extends the entire width of the hood and substantially to the two spaced end walls 13. When closed, damper 40 has a flange 41' which laps over the side and bottom edges of vent opening 27. One or more detents 41 are secured to the lower lip of the vent opening to define a surface against which lip 41' of the damper is sealed when closed tightly. The damper is mounted near its upper edge to a horizontal pivot shaft 42, allowing the damper to swing in an arc between the opened and closed positions.

Mounted within a compartment 43 is an improved actuator mechanism 44 for opening and closing the damper 40 under power by extension and retraction of the actuator within compartment 43. As will be seen from FIG. 2, the actuator when extended will cause damper 40 to be swung closed by movement in the direction of the air flow in opening 27. By retraction, the door is swung to the position illustrated in FIG. 2 and, in this position, lies against the bottom of compartment 43, closing it off to shield and protect actuator 44 and its related components from exposure to the fumes, smoke and greasy vapors which rise from stove 10 into the ventilating system A. Damper actuator compartment 43 is defined at its forward portion by wall 14 having a downwardly angled portion 45 conforming to the angle and position of damper lip 41'. Therefore, the heated air, smoke, gases and so forth rising from the cooking surface have no opportunity to enter compartment 43 but must instead enter opening 27. Also, it will be manifestly clear that it is the inner face of damper 40 which is thus exposed to the smoke and heated greasy gases so that, when damper 40 is closed by actuator 44, only the outer face (which has never been exposed to these products) will be presented, and thereby contributing to clean appearance and minimizing the efforts of cleaning up after cooking.

Actuator 44 includes an eye 46 pivotally connected to the under surface of top wall 12 by a swivel fitting 47. Actuator 44 is adapted to be extended and contracted by respective elongation or contraction axially.

Figure 5:
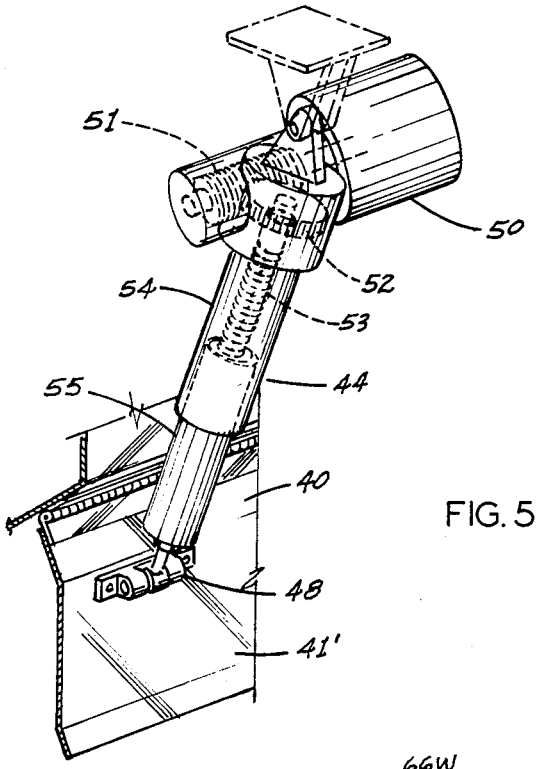
FIG. 5 is an enlarged perspective view of the actuating mechanism shown in FIGS. 1–4.

For this purpose, a reversible electric motor (see FIG. 5) is mounted in the actuator 44 and has a rotatable output shaft 51 having a helical thread formed on the end of the shaft which engages and rotatably drives a work wheel 52, and in turn, a power screw 53 keyed to the worm wheel 52 to rotate about its longitudinal axis.

Figure 3:
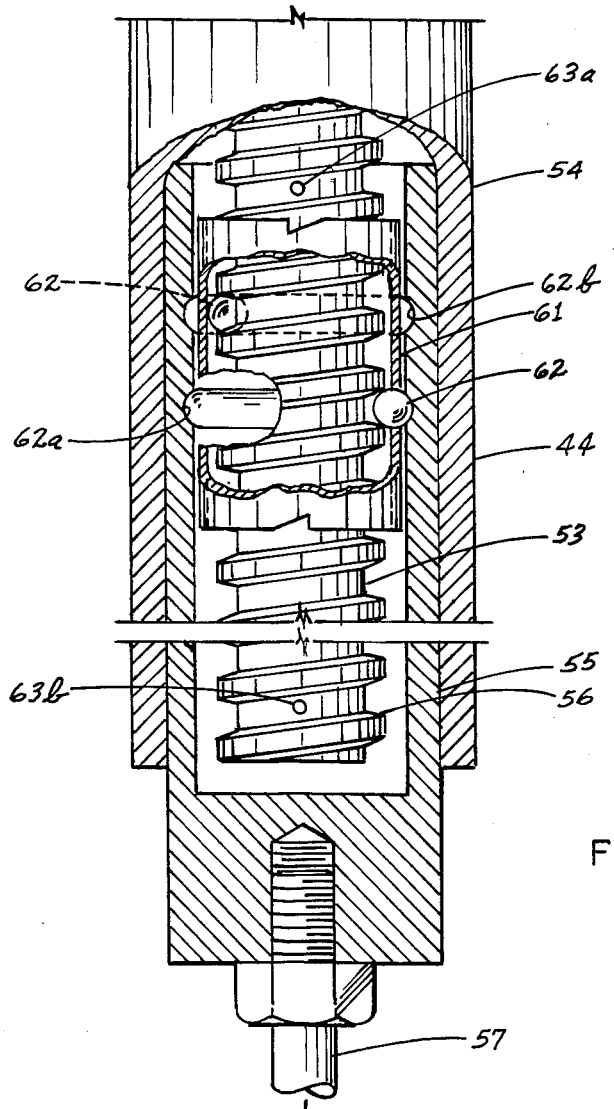
FIG. 3 is a transverse cross-section, as taken generally along line 3—3 of FIG. 2, of the actuating mechanism.
Figure 4:
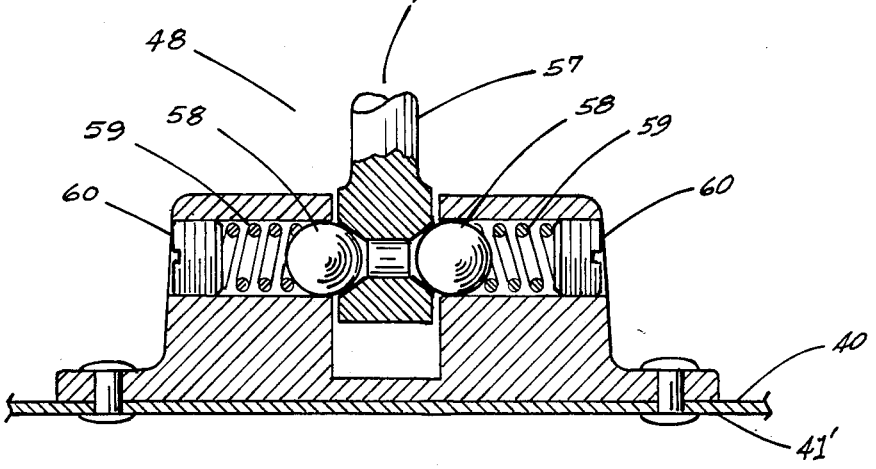
FIG. 4 is a similar cross-section, taken generally along line 4—4 of FIG. 2, and illustrating a certain break-away feature of the actuating mechanism.

Referring to FIGS. 3 and 4, a housing 54 encloses power screw 53 and telescopes over a smaller housing 55 operatively secured to power screw 53. Housing 55 thus acts as a follower, mechanically connected to the power screw 53 adapted to follow linearly along the power screw, driven by cooperation with a helical thread 56 formed on the power screw. A coupling rod 57 is further secured to the follower housing 55 to define part of the swivel connection 48 with the damper.

With the electric motor powered mechanical actuator, the opening and closing forces on the damper can be quite large because of the high mechanical advantage of the drive linkage, although the time required for opening or closing the damper is at most only a second or two. An important feature is a breakaway connection between the actuator 44 and damper 40 to minimize damage to the damper or to any structure or person accidentally trapped between the closing damper and the adjacent vent opening structure. This is specifically illustrated in FIG. 4 with the swivel connection 48 having a pair of opposed balls 58 biased by springs 59 or compressive material such as resilient synthetic material into opposing recesses or bores formed on the coupling element 57 secured to the follower housing 55. If the damper unintentionally binds against something, the balls 58 can be slid out of the recesses in any direction upon the compression of the springs 59. The breakaway force of the detent connection can be increased or decreased by screws 60 adjustably threaded into the bores and against the springs or compressive material.

As more clearly evident later, operation of the electric motor powered actuator mechanism 44 obviates the need for any limit switches or the like installed on site in the ventilator hood and permits the actuator to be driven by energization of the electric motor for a fixed period of time slightly more than that adequate to effect closing or opening of damper 40 and dispenses with the need for fixed extrinsic stops or such limit switches, etc. In this regard, design of the power screw 53 is such as to prohibit follower movement beyond a fixed location whereby two opposite end positions of the powered stroke are predetermined. As seen in FIG. 3, the follower mechanism has an annular cage 61 loosely fitting loosely over power screw 53 and providing clearance also within inner follower housing 55. Cage 61 has several openings 62*a* each of which rotatably confines a ball 62. The follower housing in turn has several annular grooves 62*b* formed in it. Each of these grooves can receive one or more of the balls 62 to axially confine cage 61 via the balls relative to the power screw 53. Each ball 62 also fits in the helical track 56 formed on the power screw 53, so that the cage 61 is restrained relative to the power screw, where each can be abutted by the cage at the respective ends of the power stroke. Rotation of power screw 53 upon activation of motor 50 causes balls 62 to move within helical thread 56 axially along the power screw, and rotating within cage 61 to shift it axially along the power screw. Balls 62 also are confined in grooves 62*b* of follower housing 55 and thereby axially move the follower to extend or retract the housings 54 and 55 relative to one another. Upon cage 61 coming into contact with pins 63*a* or 63*b* at the end of the stroke, the cage does not move further upon continued power screw rotation, but instead the balls 62 merely roll around grooves 62*b* formed in follower housing 55. This arrangement, along with the timing control to be noted hereinafter for the operation of motor 50, precludes damage to the motor and while dispensing with an/off limit switches, external limit stops, or the like installed on site in the venting structure.

Figure 6:
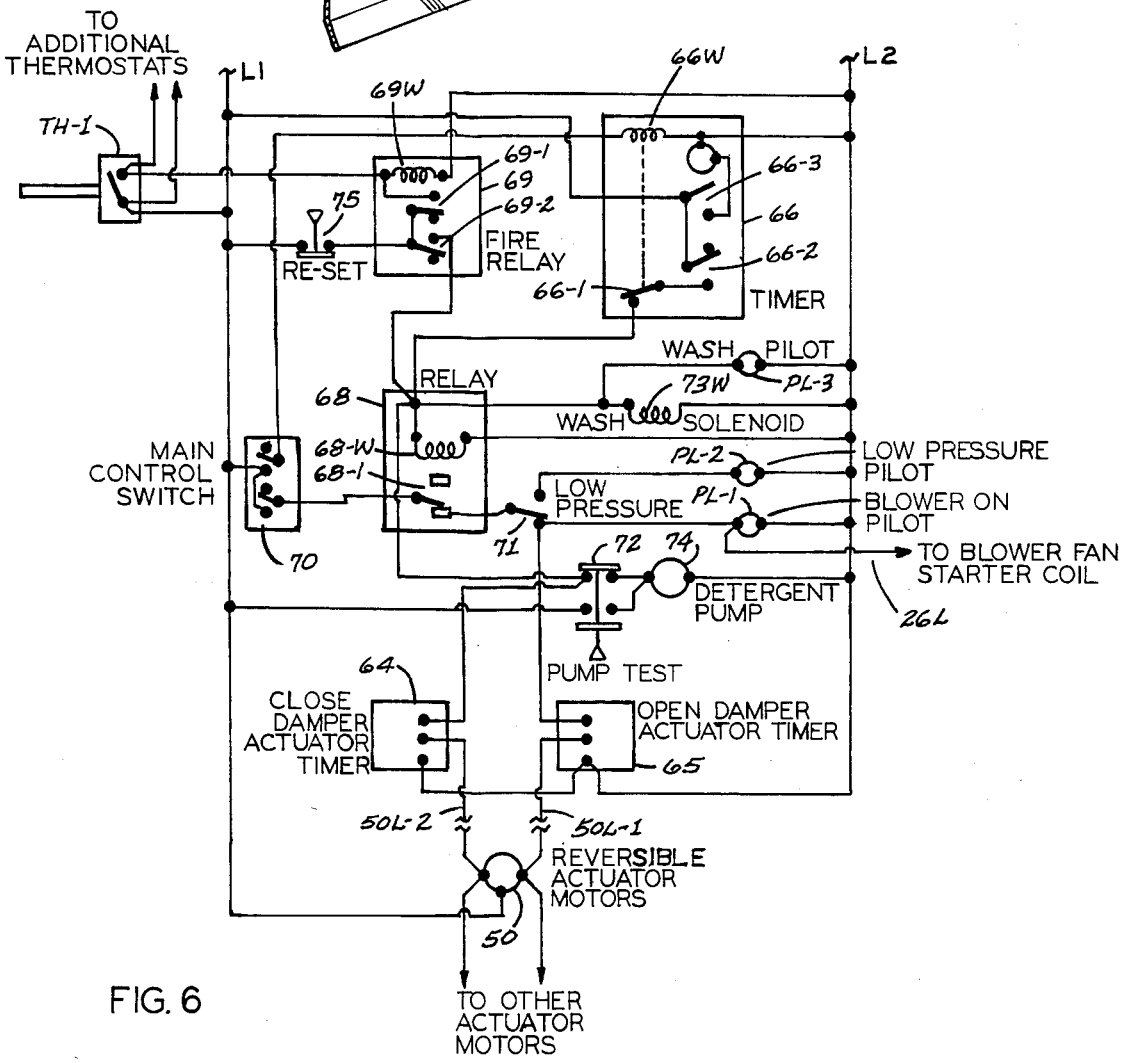
FIG. 6 is a schematic circuit diagram of control circuitry of the system.

In accordance with the invention, the new ventilating system is provided with one or more thermostats such as that designated TH-1 for sensing the temperature within unit 11 at its upper extent and, thus, responding to the temperature of the air rising therein before it enters duct 24. Thermostat TH-1, and any additional thermostats which may be provided dependent upon the width of the preferred hood configuration, are interconnected with control circuitry of the invention which operates motor 50 for closing and opening of damper 40. Referring to FIG. 6, control circuitry of the invention is illustrated.

AC power for operation of the circuitry is provided across a pair of leads L1 and L2. Fan motor 26 is not shown schematically in this circuit but a lead 26L provides interconnection between this circuit and the starter coil of motor 26. Motor 50, which drives actuator 44, is schematically illustrated, being a reversible type of motor so that it can be driven in opposite directions depending upon the polarity of the connection with it. Designated at 64 and 65 are timers for controlling the operation of motor 50 in a timed-on, cycled-off manner. Thus, timer 64 controls the timing of motor 50 for closing the damper; while timer 65 controls its energization for opening the damper. In accordance with the invention, motor 50 is energized by the appropriate timer 64, 65 for a preselected time interval slightly greater than that required for movement of damper 40 between its closed and opened position. Such movement typically may require about 2 seconds so that it will be adequate for the preselected time interval to be, for example, 2.5–5 seconds.

An additional timer 66 provides control over the time interval during which soap and water solution is provided through line 36 for spraying within extraction unit 11. Timer 66 controls the operation of a relay 68. Another relay 69 is interconnected with thermostat TH-1 (and any additional thermostats of the system) for providing various control functions in the event that an abnormal temperature is sensed by the thermostat(s).

Operator control of the system is provided by a control switch 70 of multiple pole type. This allows the operator to close or open the damper as well as automatically initiate operation of a wash cycle daily or more frequently.

To open damper 40, and operate the ventilating system, the operator moves switch 70 from the position shown to provide power from lead L1 through the normally closed contacts 68-1 of relay 68, providing power through a pressure switch 71 to lead 26L to which the blower fan starter coil is connected. This initiates operation of blower fan motor 26. Pressure switch 71 is a pressure-responsive type of switch which is normally maintained in the position shown as long as there is adequate water pressure. However, if there should be a drop from normal water pressure, switch 71 will move from the position shown to energize pilot light PL2 for signifying this condition. Otherwise, switch 71 will permit power to be supplied to lead 26L for normal operation of the blower, and a pilot light PL1 is energized to signify that the blower is operating. Also, more water pressure resulting in movement of switch 71 from the position shown will prevent power from being supplied to timer 65.

If switch 71 is in the position shown, power provided from lead L1 upon closing of switch 70 is supplied to timer 65. The timer thereupon supplies energization by means of a first motor lead 50L-1 to motor 50 which then operates in a direction for opening the damper. Upon timer 65 having timed out (e.g., 2.5–5 seconds), motor 50 ceases to operate. Of course, when the follower 61 of the actuating mechanism contacts pin 63*a*, the damper will be in a fully opened position. Accordingly, pilot light PL1 also serves to indicate that the damper is opening or, when fully opened, that it has opened.

When the operator desires to close damper 40 and deenergize blower motor 26, switch 70 is returned to the position shown. In that event, power otherwise made available to a winding 66-W is removed, permitting contacts 66-1 to assume the position shown. Power is then supplied through a set of contacts 66-1 and 66-2, which move from the position shown, through contact 66-1 and to a relay winding 68-W. It is noted that as timer 66 begins its timing cycle upon winding 66-W being deenergized, contacts 66-2 and 66-3 are closed during the timing cycle. Accordingly, power is provided to the timer 64 for controlling the closing operation of motor 50. Motor 50 is then provided with power through a lead 50L-2 for operating it in an opposite direction, and causing actuator 44 to extend and close damper 40.

When switch 70 is turned off, relay winding 66-W is deenergized, contacts 66-3 and 66-2 close and supply power through the now closed contacts 66-3 for energizing the winding 73-W of a solenoid which permits water under pressure to flow into the plumbing connected with line 36. At the same time, a further pilot light PL3 is energized to signify that a wash cycle is being initiated. Further, power is provided through switch 72 for energizing a detergent pump 74 which pumps detergent into the water being supplied to line 36. Here, it may be noted that switch 72 is provided for the purpose of temporarily energizing pump 74 for test purposes to determine that a soap mixture will be sprayed from nozzle 37 so that the operator can determine, at any time, that detergent will be pumped. After timer 64 has timed out (providing a preselected time interval slightly greater than that required for motor 50 to effect closing of damper 40), power is no longer provided to motor 50.

Wash timer 66 may provide a time interval of 5–15 minutes, typically, depending upon the amount of washing which the user requires, the timer mechanism shifts contacts 66-3 and 66-2 back to their position illustrated, deenergizing wash solenoid 73, detergent pump 74 and, of course, the wash pilot light PL3. Also, this deenergizes relay winding 68-W so that contacts 68-1 move back to the position shown. As control switch 70 is opened, power is then no longer made available to line 26L, terminating operation of blower motor 26 and, similarly, pilot light PL1.

In the event of a fire, thermostat TH-1 closes to supply power from lead L1 to energize winding 69-W of the fire relay 69. This closes contacts 69-1 and 69-2 to move from the position shown. These contacts are connected through a normally closed reset switch 75 to lead L1. Therefore, even if thermostat TH-1 should subsequently open, power will continue to be provided for energizing relay winding 69-W. Contacts 69-1 and 69-2, when operated as just described, supply power to energize relay 68-W. Similarly, power is provided to wash solenoid 73-W and wash pilot light PL3. The energization of the wash solenoid causes water to be provided to line 36 and spray is initiated within the ventilating system. Also, power is then supplied to timer actuator 64 (and also to pump 74). Timer 64 is, accordingly, energized to begin its timing cycle, during which it provides power through lead 50L-2 to motor 50. The motor is driven in a direction for closing damper 40, if not already closed. Even if the damper were already closed, the actuating mechanism 44 will operate to permit running of the motor 50 without damage to the apparatus, a decided advantage, and will, in any event, ensure that the damper 40 moves quickly to the closed position.

As noted above, even if thermostat TH-1 should subsequently open, as when the fire is extinguished by the spraying of the water, or for whatever reason, the connection with lead L1 through switch 75 will cause fire relay winding 69-W to remain locked in and energized and spray will, therefore, continue for an indefinite period to ensure against the possibility of a flare-up or resurgence of the fire. Authorized personnal, such as firemen or the operator of the establishment, can subsequently press reset switch 75 to permit winding 69-W to be deenergized, resetting relay 69 and terminating further spraying resulting from the energization of wash solenoid 73-W. Of course, if the fire had still not been extinguished, thermostat TH-1 would again close to reinitiate a wash cycle.

In view of the foregoing, automatic operation of the system is relatively fail-safe, providing a very high degree of assurance that the new ventilating system will provide protection against fire even in the absence of personnel and will operate as necessary to extinguish flame regardless of the time of the fire, whether such be during the hours of operation of the establishment, or when closed. Here again, movement of damper 40 when closing in the direction of the air flow through the ventilating system ensures that the damper will not have to resist the flow of air which may exist in the event of a fire until blower shut-off.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. An extraction unit for a kitchen ventilating system including an exhaust duct and a fan for causing gases to be drawn into said extraction unit and to flow therethrough for centrifugal extraction of grease and the like from said gases normally without spray of water within said extraction unit, and for causing said gases subsequently to be exhausted through said exhaust duct, said extraction unit comprising a structure defining a plenum, an extraction chamber communicating with said plenum, and an exhaust gas inlet opening into said extraction chamber, said extraction chamber including an inclined, planar floor sloping rearwardly from said inlet and a rear wall directed upwardly from said floor, baffle means within said extraction chamber for causing gases entering said extraction chamber substantially to follow said floor, said floor including a depressed portion over only a rearward portion thereof for defining a grease-receiving gutter proximate said rear wall, and drain means communicating with said gutter, said floor and said rear wall defining an acute angle, said depressed portion being formed by a lip directed downwardly from a planar extent of said floor, said gutter including a floor portion constituted by a substantially planar, rearwardly sloping surface substantially parallel to said floor and spaced substantially below the level of the planar extend of the floor, said floor, said lip and said gutter floor portion all being constituted by a single continuous sheet of metal, said gutter having a longitudinal extent transverse to the flow of gases into said extraction unit, said gutter being proximate said rear wall and thereby substantially at the apex of said floor and said rear wall, said baffle means being located relative to said rear wall for causing said exhaust gases following said floor to follow a sharply upwardly turning path, which path crosses said depressed portion of the floor, for centrifugal extraction of grease and the like entrained in said exhaust gases, thereby causing particles and droplets of grease and the like to be separated from said exhaust gases, captured in said gutter and drained therefrom by said drain means without resort to spray of water in said extraction chamber, said floor and depressed portion being mutually configured for causing said gases substantially to be prevented from flowing within said gutter without requiring an exhaust gas deflector along said gutter, whereby grease and the like separated from said gases are captured and prevented from being reentrained within the gases flowing through said extraction unit and exhausted into said exhaust duct.

2. An extraction unit according to claim 1 and further characterized by a damper hingedly disposed for movement between positions closing and opening said inlet, and an actuator for driving said damper between its closed and opened positions, said extraction unit including an external surface, said damper being hinged relative to said external surface for rotation about an axis located above said inlet, said damper opening outwardly relative to said inlet but closing by movement inwardly toward said external surface and in the direction of gases drawn into said inlet, said damper being of door-like configuration including inner and outer faces, the inner face being exposed to, but said outer face not being exposed to, gases drawn into said inlet when said damper is open.

3. An extraction unit according to claim 1 and further comprising thermostat means located within said extraction unit for sensing the temperature therein and for electrically switching in response to abnormally high temperature sensed within said extraction unit, spray means within said extraction unit for spraying water therein, electrically controllable valve means for controlling the supply of water to said spray means, and circuit means operating to actuate said valve means for causing spraying within said extraction unit in response to said switching.

4. An extraction unit for a kitchen ventilating system including an exhaust duct and a fan for causing gases to be drawn into said extraction unit and to flow therethrough for centrifugal extraction of grease and the like from said gases normally without spray of water within said extraction unit and for causing said gases subsequently to be exhausted through said exhaust duct, said extraction unit comprising a structure defining a plenum, an extraction chamber communicating with said plenum, and an exhaust gas inlet opening into said extraction chamber, said extraction unit including a damper hingedly disposed for movement between positions closing and opening said inlet, and an actuator for driving said damper between its closed and opened positions, said extraction unit including a structural extension above said damper for housing said actuator, said actuator being extendable-retractable in nature and connected to said damper through a further opening within said structural extension, said damper, when opened, overlying and thereby closing said further opening, said extraction chamber including an inclined, planar floor sloping rearwardly from said inlet and a rear wall directed upwardly from said floor, baffle means within said extraction chamber for causing gases entering said extraction chamber substantially to follow said floor, said floor including a depressed portion over only a rearward portion thereof for defining a grease-receiving gutter proximate said rear wall, and drain means communicating with said gutter, said baffle means being located relative to said rear wall for causing said exhaust gases following said floor to follow a sharply upwardly turning path crossing said depressed portion of the floor for centrifugal extraction of grease and the like entrained in said exhaust gases, thereby causing particles and droplets of grease and the like to be separated from said exhaust gases, captured in said gutter and drained therefrom by said drain means without resort to spray of water in said extraction chamber, said floor and depressed portion being mutually configured for causing said gases substantially to be prevented from flowing within said gutter, whereby grease and the like separated from said gases are captured and prevented from being re-entrained within the gases flowing through said extraction unit and exhausted into said exhaust duct.

5. An extraction unit according to claim 4, and further characterized by said actuator being extendable-retractable in nature and including an extension-retraction mechanism, and an electric motor for driving said mechanism to produce movement of said damper between its opened and closed positions by extension and retraction of said mechanism.

6. An extraction unit according to claim 5, and further characterized by movement of said damper between its opened and closed positions occuring in a predetermined time interval required for corresponding extension or retraction of said mechanism, there being means for controlling energizing of said electric motor for providing energization thereof only for a preselected time interval greater than said predetermined time interval.

7. An extraction unit according to claim 6, said motor being electrically reversible, said timing means establishing first and second timing intervals for respectively controlling the energization of said motor for rotation in first and second directions, whereby said first timing interval determines energization of said motor during opening of said damper and said second timing interval determines the energization of said motor during closing of said damper.

8. An extraction unit according to claim 5, said actuator comprising an elongated screw turned by said motor, follower means driven by said screw for being advanced in either of two directions along the direction of elongation of said screw, and ball means interengaging said follower means and screw, said follower means being configured to define predetermined limits of movement of said follower means in either of said directions and for providing free circulation of said balls relative to said screw and follower means upon either of said limits being reached.

9. An extraction unit according to claim 5 and further comprising thermostat means located within said extraction unit for sensing the temperature therein and for providing electrical switching in response to abnormally high temperature sensed within said extraction unit, and circuit means interconnecting said thermostat means with said motor for causing energization thereof for closing said damper in response to said switching.

10. An extraction unit according to claim 9 and further comprising spray means within said extraction unit for spraying water therein, electrically controllable valve means for controlling the supply of water to said spray means, said circuit means operating to actuate said valve means for causing water spray within said extraction unit in response to said switching.

11. An extraction unit according to claim 10, said motor being selectively energizable by operator initiation for selective opening and closing of said damper, said circuit means being also operative to provide for initiation of spraying by said spray means for a timed spray interval upon operator initiation for closing said damper.

12. An extraction unit according to claim 11, said circuit means being responsive to said thermostat means for causing spraying by said spray means beyond said timed spray interval in response to said switching by said thermostat means.

13. An extraction unit for a kitchen ventilating system including an exhaust duct and a fan for causing gases to be drawn into said extraction unit and to flow therethrough for centrifugal extraction of grease and the like from said gases normally without spray of water within said extraction unit, and for causing said gases subsequently to be exhausted through said exhaust duct, said extraction unit comprising a structure defining a plenum, an extraction chamber communicating with said plenum, and an exhaust gas inlet opening into said extraction chamber, a damper hingedly disposed for movement between positions closing and opening said exhaust gas inlet, and an actuator for driving said damper between said opened and closed positions, a structural extension above said damper for housing said actuator, said actuator being extendable-retractable in nature and connected to said damper through a further opening within said structural extension, said damper, when opened, overlying and thereby closing said further opening, said extraction chamber including an inclined, planar floor sloping rearwardly from said inlet and a rear wall directed upwardly from said floor, baffle means within said extraction chamber for causing gases entering said extraction chamber substantially to follow said floor, said floor including a depressed portion over only a rearward portion thereof for defining a grease-receiving gutter proximate said rear wall, and drain means communicating with said gutter, said baffle means being located relative to said rear wall for causing said exhaust gases following said floor to follow a sharply upwardly turning path crossing said depressed portion of the floor for centrifugal extraction of grease and the like entrained in said exhaust gases, thereby causing particles and droplets of grease and the like to be separated from said exhaust gases, captured in said gutter and drained therefrom by said drain means without resort to spray of water in said extraction chamber, said floor and depressed portion being mutually configured for causing said gases substantially to be prevented from flowing within said gutter, whereby grease and the like separated from said gases are captured and prevented from being re-entrained within the gases flowing through said extraction unit and exhausted into said exhaust duct, said actuator being extendable-retractable in nature and including an extension-retraction mechanism, and an electric motor for driving said mechanism to produce movement of said damper between its opened and closed positions by extension and retraction of said mechanism, said actuator being interconnected with said damper by a break-away device for safely providing breaking away of the connection of said actuator to said damper in the event of said damper being blocked during movement of said damper between its opened and closed positions.

* * * * *